US009806409B2

(12) United States Patent
Yang et al.

(10) Patent No.: US 9,806,409 B2
(45) Date of Patent: Oct. 31, 2017

(54) EMBEDDED ANTENNA DEVICE FOR ELECTRONIC COMMUNICATION DEVICE

(75) Inventors: Tae-Sik Yang, Suwon-si (KR); Ju-Hyung Lee, Gwacheon-si (KR); Hyeong-Dong Kim, Seoul (KR); Sin-Hyung Jeon, Seoul (KR); Joong-Ho Jeong, Seoul (KR)

(73) Assignees: Samsung Electronics Co., Ltd., Suwon-si (KR); Industry-University Cooperation Foundation Hanyang University, Seoul (KR)

( * ) Notice: Subject to any disclaimer, the term of this patent is extended or adjusted under 35 U.S.C. 154(b) by 216 days.

(21) Appl. No.: 14/005,694

(22) PCT Filed: Mar. 26, 2012

(86) PCT No.: PCT/KR2012/002187

§ 371 (c)(1),
(2), (4) Date: Sep. 17, 2013

(87) PCT Pub. No.: WO2012/128601

PCT Pub. Date: Sep. 27, 2012

(65) Prior Publication Data

US 2014/0009358 A1 Jan. 9, 2014

(30) Foreign Application Priority Data

Mar. 24, 2011 (KR) ..... 10-2011-0026177

(51) Int. Cl.
*H01Q 1/48* (2006.01)
*H01Q 1/24* (2006.01)
(Continued)

(52) U.S. Cl.
CPC ..... *H01Q 1/48* (2013.01); *H01Q 1/243* (2013.01); *H01Q 1/38* (2013.01); *H01Q 9/42* (2013.01)

(58) Field of Classification Search
CPC ..... H01Q 1/48; H01Q 1/38; H01Q 1/243; H01Q 9/42
See application file for complete search history.

(56) References Cited

U.S. PATENT DOCUMENTS 6,842,158 B2 * 1/2005 Jo ..... H01Q 1/243 343/700 MS
8,988,286 B2 * 3/2015 Ahn et al. ..... 343/700 MS
2011/0037665 A1 2/2011 Ahn et al.

FOREIGN PATENT DOCUMENTS

KR 10-2006-0099778 A 9/2006
KR 10-2009-0019534 A 2/2009
(Continued)

*Primary Examiner* — Graham Smith
*Assistant Examiner* — Noel Maldonado
(74) *Attorney, Agent, or Firm* — Jefferson IP Law, LLP

(57) ABSTRACT

A built-in antenna device for an electronic device for communication is provided. The antenna device includes a substrate, an antenna radiator, and a transmission line. The substrate includes a grounding region and a non-grounding region. The antenna radiator is disposed in the non-grounding region of the substrate and fed from a feeding portion provided to the substrate. The transmission line branches from the antenna radiator and is disposed in vicinity of the grounding region to have a predetermined length and a predetermined width. The antenna device controls reactance by coupling the transmission line with the grounding region to allow the antenna radiator to operate in at least one desired band.

16 Claims, 13 Drawing Sheets

(51) Int. Cl.
*H01Q 1/38* (2006.01)
*H01Q 9/42* (2006.01)

(56) References Cited

FOREIGN PATENT DOCUMENTS

KR 10-2010-0029419 A 3/2010
KR 10-2011-0018072 A 2/2011

* cited by examiner

EMBEDDED ANTENNA DEVICE FOR ELECTRONIC COMMUNICATION DEVICE

BACKGROUND OF THE INVENTION

1. Field of the Invention

The present invention relates to a built-in antenna device. More particularly, the present invention relates to a built-in antenna device for an electronic device for communication, realized for contributing to a slim profile of the device and simultaneously securing a wideband.

2. Description of the Related Art

Recently, an electronic device for communication, having various functions and designs emerges. A portable terminal is a representative device of these electronic devices. The portable terminal becomes lightweight and miniaturized in a slim profile and simultaneously diversity of its function stands out even more. Therefore, the portable terminal places an emphasis on reduction of its volume while maintaining or improving its functions in order to meet this desire of a consumer.

Particularly, a folder type terminal and a slide type terminal among the above-mentioned terminals form a mainstream. Recently, a bar type terminal (a so-called 'smartphone') where most of the front side serves as a display unit (a touchscreen unit) is brought to the market constantly. As a touch technology develops, a keypad using a separate metal dome is excluded if possible, an electronic device is operated using a touchscreen unit, so that a consumer's various tastes are met.

Particularly, in case of an antenna device of the above-mentioned terminals, an external protrusion type antenna device has been used conventionally. For example, for an antenna device, a rod antenna (or a whip antenna) installed to protrude to the outside of the terminal by a predetermined length, and a helical antenna have been used. In this case, the antenna becomes a most fragile portion that may be destroyed when the terminal drops down, and causes a problem of reducing portability. Therefore, recently, a plate type built-in antenna (a so-called 'internal antenna' or an 'intenna') mounted inside the terminal is used generally, and efforts are made to improve the characteristic of the built-in antenna device and simultaneously improve an assembly characteristic and productivity.

The plate type built-in antenna device is mounted on a carrier having a predetermined height and provides a distance with respect to a grounding surface of a substrate in the lower side, so that swift radiation performance is realized. However, recently, a technology excluding this carrier and directly installing or forming an antenna device on a Printed Circuit Board (PCB) develops. Furthermore, recently, an antenna device is formed to realize a multiple band (for example, at least two resonance points) using one radiator because a slot shape of the upper surface of the radiator may be formed in various ways so that it is suitable for each desired band. For example, since recently one terminal is realized to use three or more bands such as a Wideband Code Division Multiple Access (WCDMA), a Digital Cellular System (DCS), a Global System for Mobile Communication (GSM), etc., use convenience of the terminal increases.

A most basic antenna device among the above built-in antenna devices is a dipole antenna device operating in a free space. When the dipole antenna device is used together with a metal ground (a grounding surface), it may be realized as a monopole antenna device by an image theory. However, when a radiator is got close to the ground to meet requirements of an antenna device whose profile is low, a capacitive component increases. To reduce this capacitive component, a shorting pin is added to a feeding portion and so an inductive component is increased, so that resonance may be generated in a desired frequency band. This antenna device is a so-called Planar Inverted F Antenna (PIFA). The PIFA is an antenna type used the most as a built-in antenna device of a portable terminal recently.

However, the above-described built-in antenna device should be realized to cover all of various frequency bands. Accordingly, a separate antenna radiator should be used for each relevant band, or even when a single antenna radiator is used, a volume thereof increases.

Therefore, a built-in antenna device capable of contributing slimness of an electronic device by not increasing the volume of the device or reducing the volume while covering all of frequency bands increasing gradually is indispensably required.

SUMMARY OF THE INVENTION

An aspect of the present invention is to address at least the above-mentioned problems and/or disadvantages and to provide at least the advantages described below. Accordingly, an aspect of the present invention is to provide a built-in antenna device for an electronic device for communication, realized to operate in a multiple band without increasing an installation effective space inside the electronic device.

Another aspect of the present invention is to provide a built-in antenna device for an electronic device for communication, realized to operate in a lower frequency band together with an existing communication band.

Still another aspect of the present invention is to provide a built-in antenna device for an electronic device for communication, realized to be easily installed and simultaneously to contribute slimness of the electronic device.

In accordance with an aspect of the present invention, a built-in antenna device for an electronic device for communication is provided. The antenna device includes a substrate including a grounding region and a non-grounding region, an antenna radiator disposed in the non-grounding region of the substrate and fed from a feeding portion provided to the substrate, and a transmission line branching from the antenna radiator and disposed in vicinity of the grounding region to have a predetermined length and a predetermined width.

Preferably, the transmission line is disposed in vicinity of the grounding region of the substrate, so that it may be coupled with the grounding region. Therefore, reactance of the antenna radiator may be controlled to operate in a desired frequency band by changing a variable factor such as a length, a width, etc. of the transmission line.

An electronic device for communication according to the present invention has an effect of allowing the built-in antenna radiator to operate in at least one desired frequency band by allowing a transmission line to branch from a feeding line of an existing built-in antenna device and thus controlling reactance.

Other aspects, advantages and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features and advantages of certain exemplary embodiments of the present invention will be more apparent from the following description taken in conjunction with the accompanying drawings in which.

Throughout the drawings, like reference numerals will be understood to refer to like parts, components and structures.

DETAILED DESCRIPTION OF EXEMPLARY EMBODIMENTS

A preferred embodiment of the present invention is described below in detail with reference to the accompanying drawings. However, descriptions of well-known functions and constructions are omitted since they may obscure the spirit of the present invention unnecessarily.

Though a portable terminal as an electronic device for communication is illustrated and described in describing the present invention, it is not limited thereto. For example, the present invention is applicable to an electronic device of various fields, used for communication even though it is not carried with.

Furthermore, in describing the present invention, a bar type terminal has been illustrated and an antenna device mounted therein has been described. However, a built-in antenna device according to the present invention may be mounted inside a terminal having various open types such as a folder type terminal, a slide type terminal, etc.

Figure 1:
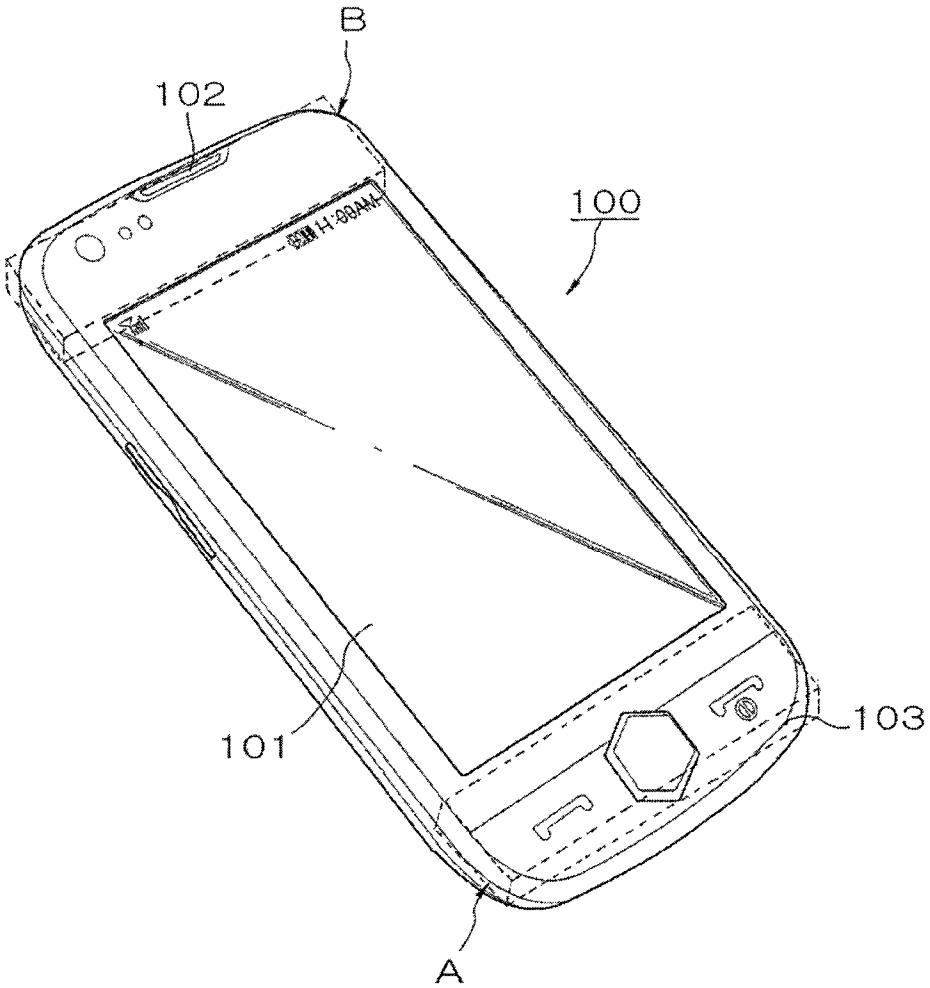
FIG. 1 is a perspective view illustrating a portable terminal having a built-in antenna device according to a preferred embodiment of the present invention.

FIG. 1 is a perspective view illustrating a portable terminal having a built-in antenna device according to a preferred embodiment of the present invention.

FIG. 1 is a perspective view of a portable terminal 100 to which a built-in antenna device according to the present invention is applied. A display unit 101 is installed on the front side of the terminal. For example, it is preferable that the display unit 101 is installed as a touchscreen unit for performing data input/output together. An ear piece 102 which is a receiver is installed in the upper portion of the display unit 101, and a microphone unit 103 which is a transmitter is installed in the lower portion of the display unit 101. Though not shown, a camera module and a speaker module may be further installed, and various additional units for realizing other known additional functions may be installed.

Meanwhile, a built-in antenna device 1 (of FIG. 2) according to the present invention may be disposed in various positions of the portable terminal 100. This means an installation position is relatively free compared to the case where conventionally a built-in antenna device should be installed in one specific place even though space extension is accepted to some extent due to a limitation in a carrier installation space.

Therefore, a built-in antenna device according to the present invention may be installed in relatively various positions, anywhere inside a portable terminal where a PCB is installed. Preferably, for normal performance manifestation of the built-in antenna device, the built-in antenna device may be installed in the lower portion A or the upper portion B of the terminal.

Figure 2:
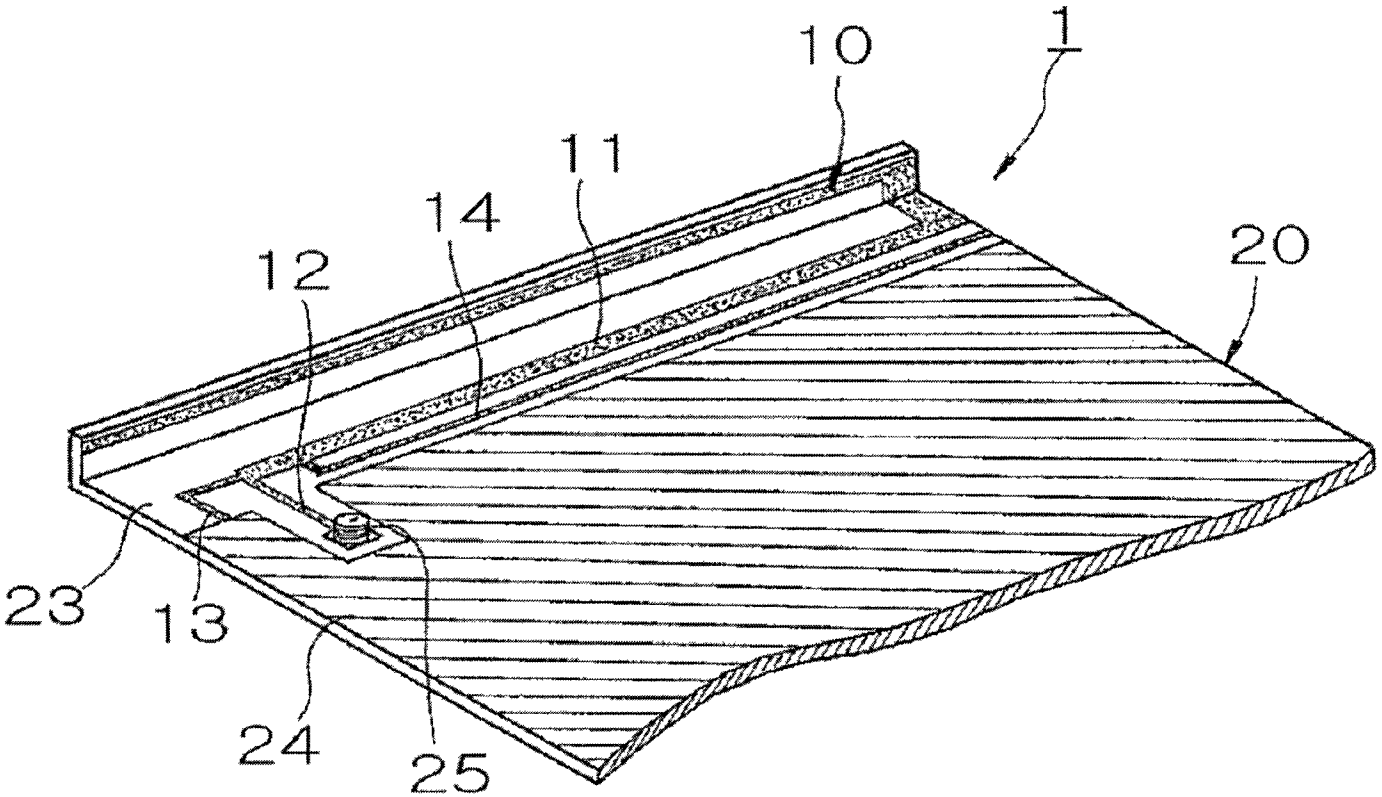
FIG. 2 is a perspective view of a built-in antenna device according to a preferred embodiment of the present invention.
Figure 3:
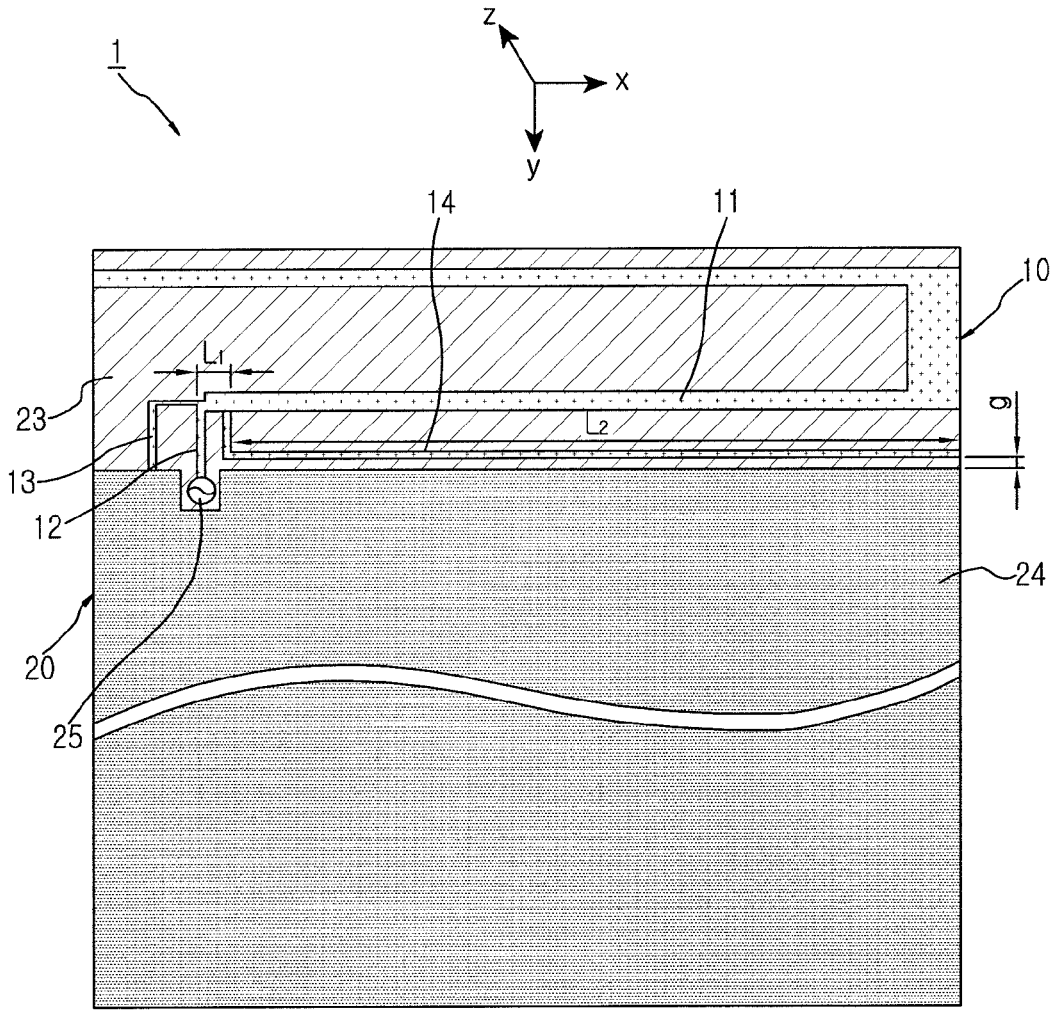
FIG. 3 is a schematic view illustrating the construction of a built-in antenna device according to a preferred embodiment of the present invention.

FIG. 2 is a perspective view of a built-in antenna device according to a preferred embodiment of the present invention, and FIG. 3 is a schematic view illustrating the construction of a built-in antenna device according to a preferred embodiment of the present invention.

As illustrated in FIGS. 2 and 3, the built-in antenna device 1 according to the present invention includes a substrate 20 installed inside a portable terminal, an antenna radiator 10 disposed at a pertinent position of the substrate 20, and a transmission line 14 branching from a radiation line 11 of the antenna radiator 10 and operating by coupling to a grounding region 24 of the substrate 20.

The substrate 20 includes the grounding region 24 and a non-grounding region 23. Preferably, the antenna radiator 10 according to the present invention is disposed in the non-grounding region 23.

The antenna radiator 10 and the transmission line 14 may be realized together via a patterning operation while the substrate is formed. However, they are not limited thereto, but they are applicable in such a way that a predetermined metal plate or a Flexible Printed Circuit Board (FPCB), etc. are attached on the substrate. Preferably, the antenna radiator 10 is a PIFA. Therefore, one end of the antenna radiator branches into two portions to include a feeding line 12 and a grounding line 13. The feeding line 12 may be electrically connected to an RF connector 25 installed to the substrate 20, and the grounding line 13 may be electrically connected to the grounding region 24 of the substrate 20, so that the antenna radiator operates.

Meanwhile, the transmission line 14 has a predetermined width and a predetermined length and is disposed such that it branches from the radiation line 11 of the antenna radiator 10. The transmission line 14 has a distance g close to the grounding region 24 generally, so that the transmission line 14 may operate as an additional grounding body, not an auxiliary radiator of the antenna radiator 10.

The transmission line 14 provides capacitive reactance to the antenna radiator 10 via a transmission line structure. Therefore, the purpose of the transmission line 14 is not radiation but reactance control. That is, a general built-in antenna device generates an additional resonance using an additional branch generally. At this point, the form of the additional branch is similar to the structure of the transmission line 14 of the present invention. However, the transmission line 14 according to the present invention is disposed close to the grounding region 23 of the substrate 20 and operates as an additional grounding body via a coupling operation, thereby aiming at reactance control, not radiation.

Therefore, the above-described transmission line 14 may control reactance with consideration of a distance g between the grounding region 24 and the transmission line 14, and an entire length of $L_1+L_2$. Preferably, the transmission line 14 is positioned very close to the grounding region 24, so that self radiation does not occur. That is, a gap g between the grounding region 24 and the transmission line 14 has an electric length of $\lambda/100$ or less in a general communication band of 700 MHz~2170 MHz. Therefore, the transmission line 14 does not generate self radiation but operates as a portion of a feeding structure to control a capacitance value which is a reactance portion of input impedance of the antenna radiator 10. Of course, the transmission line 14 may control the reactance value using a portion of an inductance value as well as a simple capacitance value in a distributed form, not a lumped form, and the electric length of the transmission line 14 should meet the condition of $L_1+L_2<\lambda/4$.

Also, it is revealed from a known input admittance equation $Y_b=jB=j\cot(\beta/)/Z_0$ by the transmission line 14 that the input admittance may be controlled by $L_1+L_2$ and the gap g (or characteristic impedance, $Z_0$) between the ground and the transmission line.

Figure 4A:
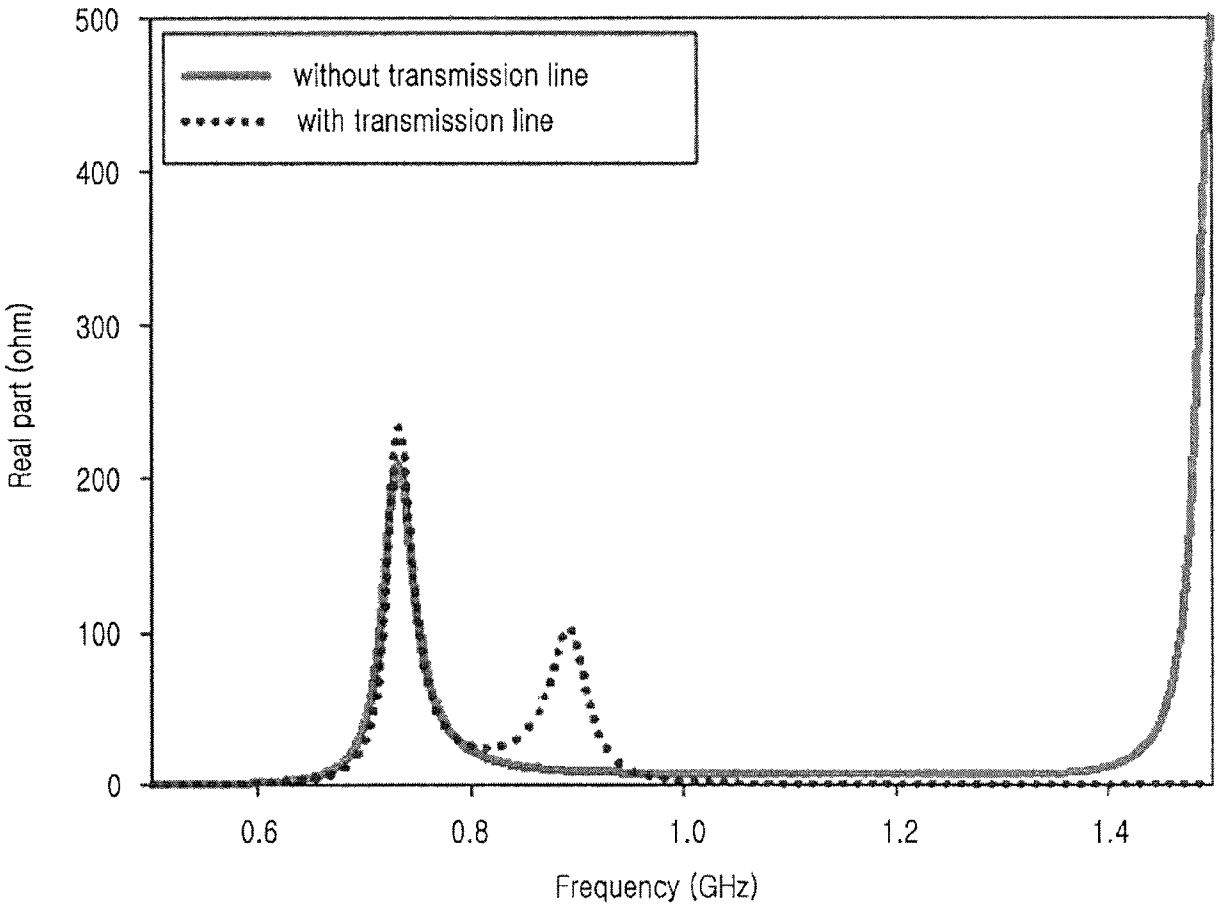
FIGS. 4A to 4C are graphs comparing real & reactance curves of a built-in antenna device according to a preferred embodiment of the present invention and the conventional built-in antenna device.
Figure 4B:
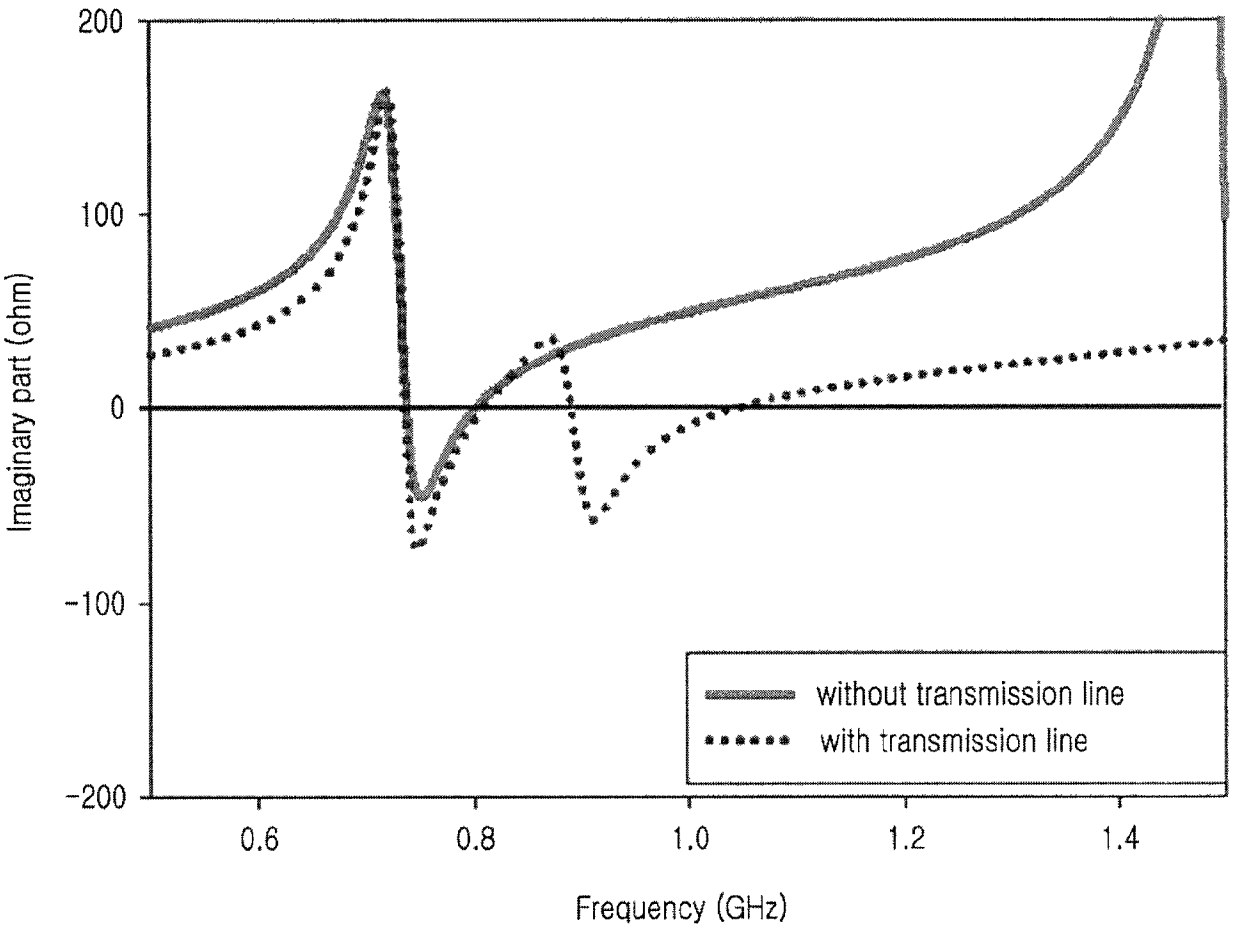
Figure 4C:
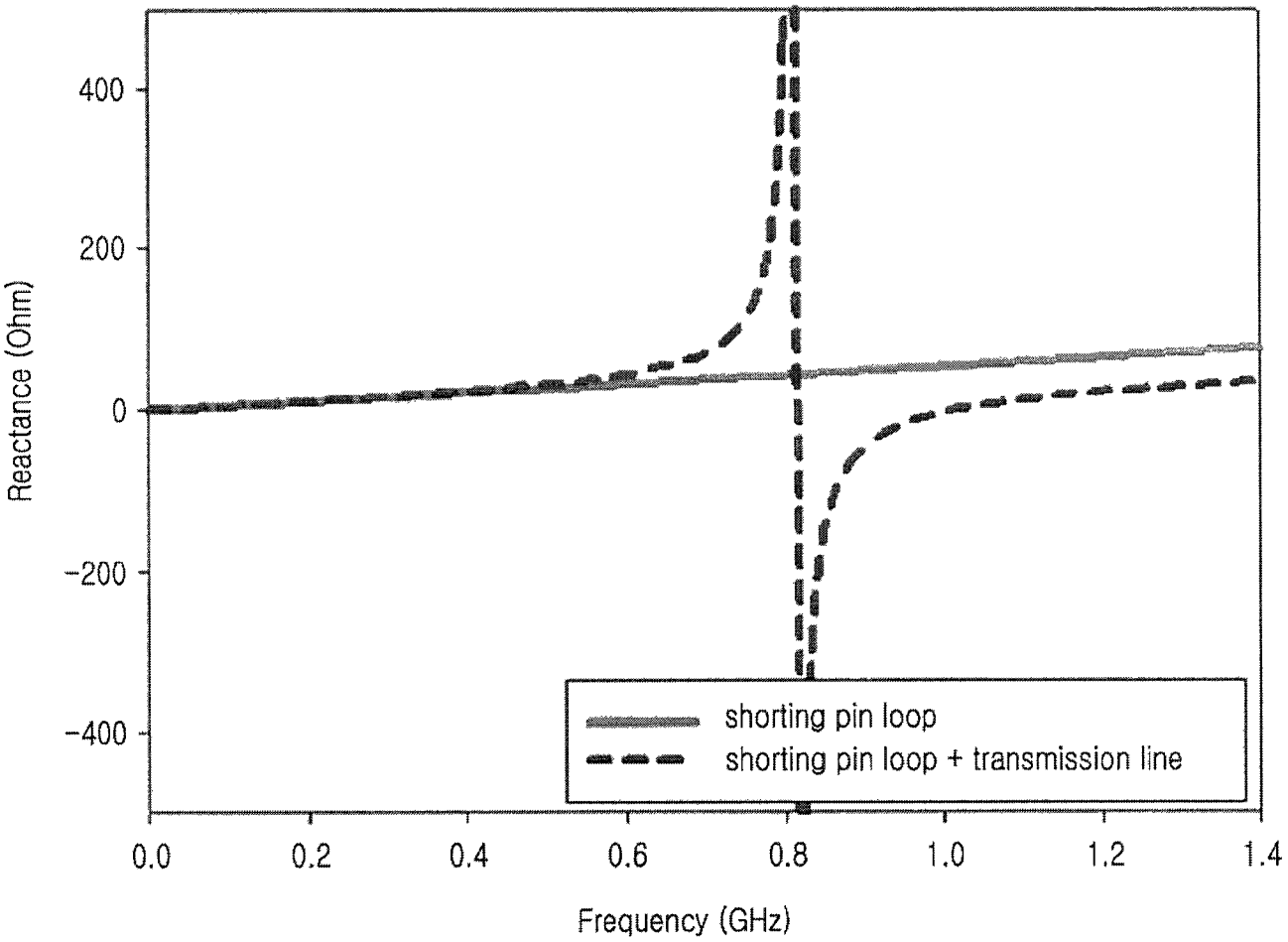

FIGS. 4A to 4C are graphs comparing real & reactance curves of a built-in antenna device according to a preferred embodiment of the present invention and the conventional built-in antenna device. Referring to FIGS. 4A to 4C, a real & reactance curve of a shape different from that of the conventional PIFA structure may be obtained. That is, it is shown that besides a band of 700 MHz which is a basic resonance mode, an additional resonance which cannot be observed in the conventional PIFA is generated in a band of 900 MHz.

Also, FIG. 4C expresses reactance (real part=0) provided by only a feeding structure, excluding the structure of the antenna radiator. Since a shorting loop structure which is a feeding structure of a general PIFA has only an inductance value, it has only a positive reactance, but a structure to which the transmission line according to the present invention has been applied has a capacitance component, so that both positive and negative reactance components are shown.

Figure 5:
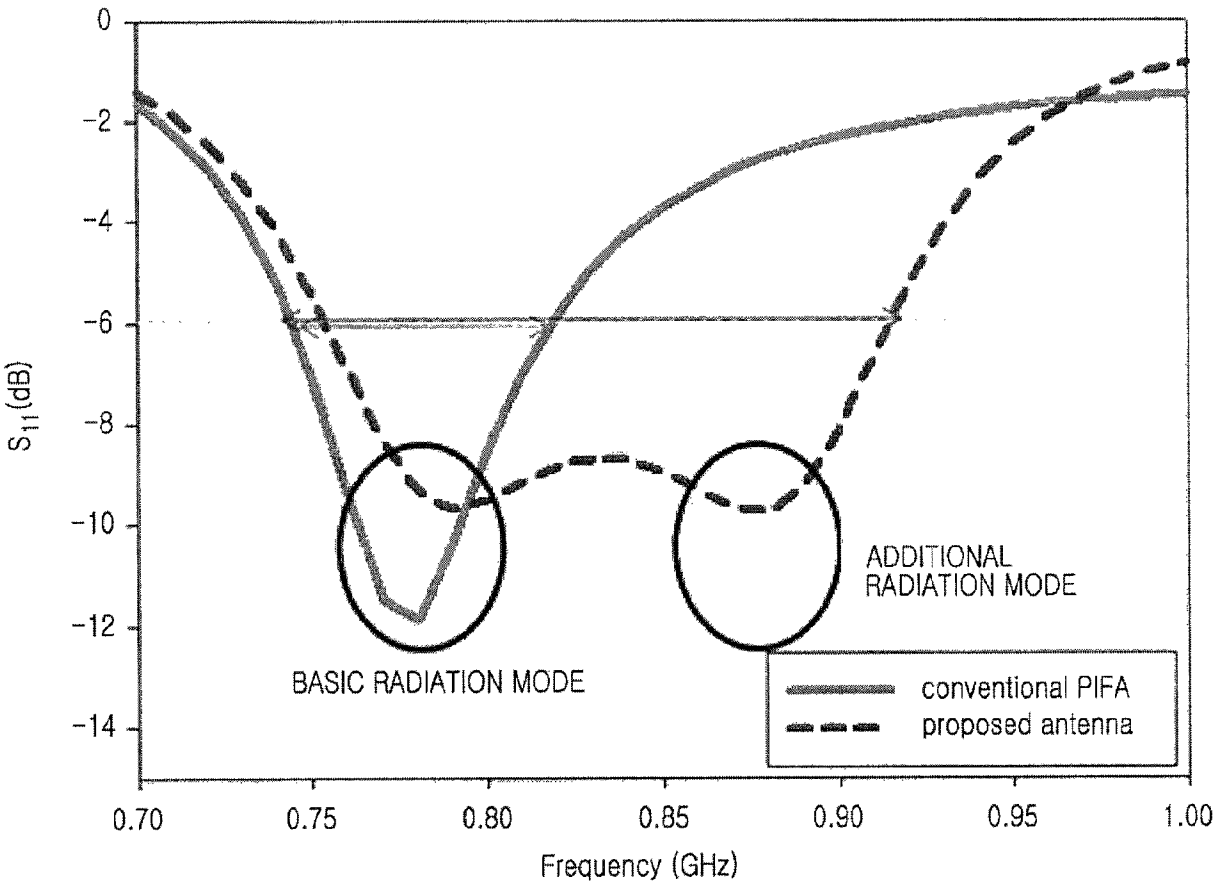
FIG. 5 is a graph comparing reflection coefficients S11 of a built-in antenna device according to a preferred embodiment of the present invention and the conventional built-in antenna device.

FIG. 5 is a graph comparing reflection coefficients S11 of a built-in antenna device according to a preferred embodiment of the present invention and the conventional built-in antenna device. A low band wideband effect that cannot be obtained in the conventional antenna radiator may be obtained by the transmission line according to the present invention. That is, the conventional PIFA covers a band of 70 MHz based on −6 dB, but when the transmission line according to the present invention is applied, a wideband of about 170 MHz may be secured (a 100 MHz band may be additionally secured).

Figure 6:
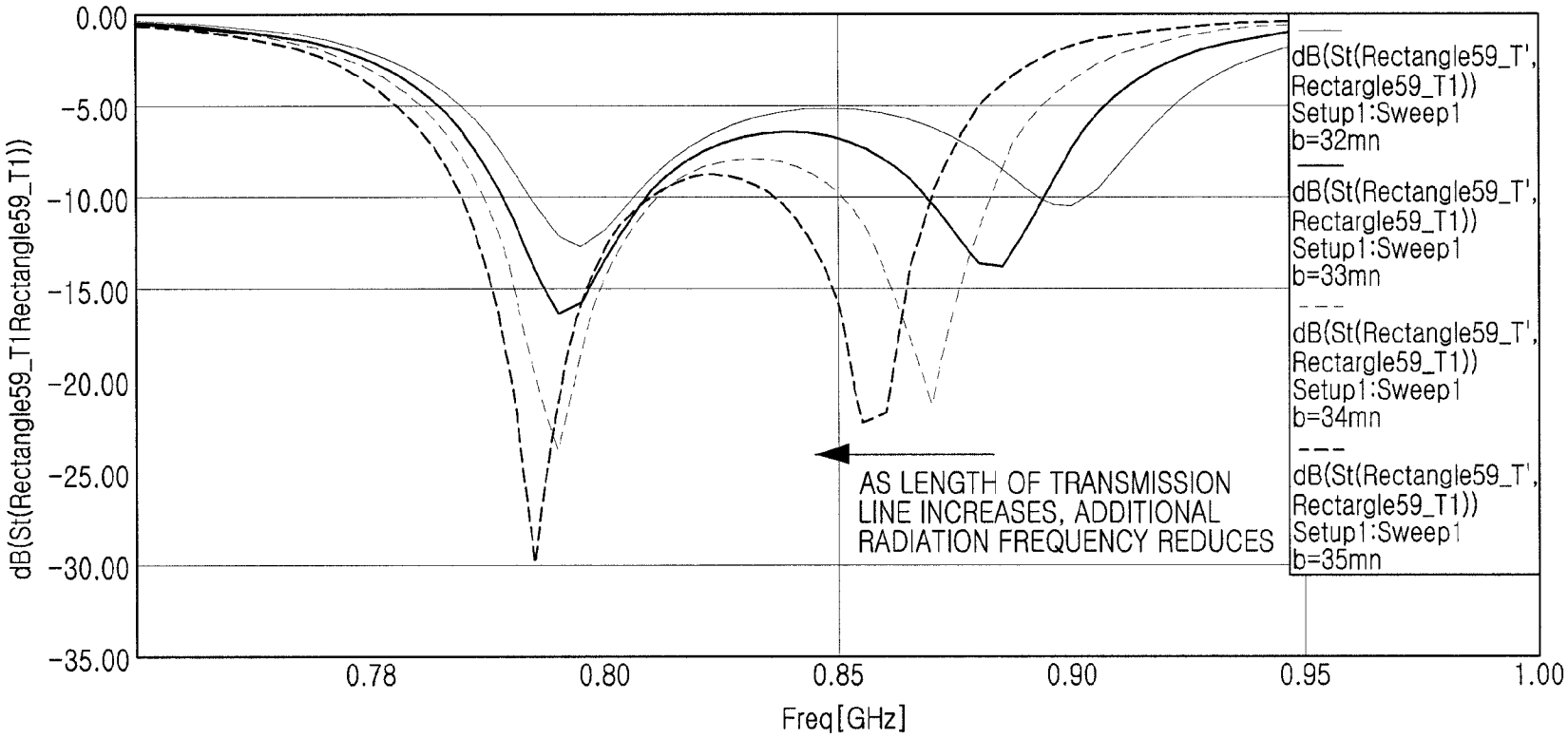
FIG. 6 is a graph comparing reflection coefficient S11 depending on a length change of a transmission line of a built-in antenna device according to a preferred embodiment of the present invention.

FIG. 6 is a graph comparing reflection coefficients S11 depending on a length change of a transmission line of a built-in antenna device according to a preferred embodiment of the present invention. As the length of the transmission line configured according to the present invention increases, an additional radiation frequency reduces.

Figure 7A:
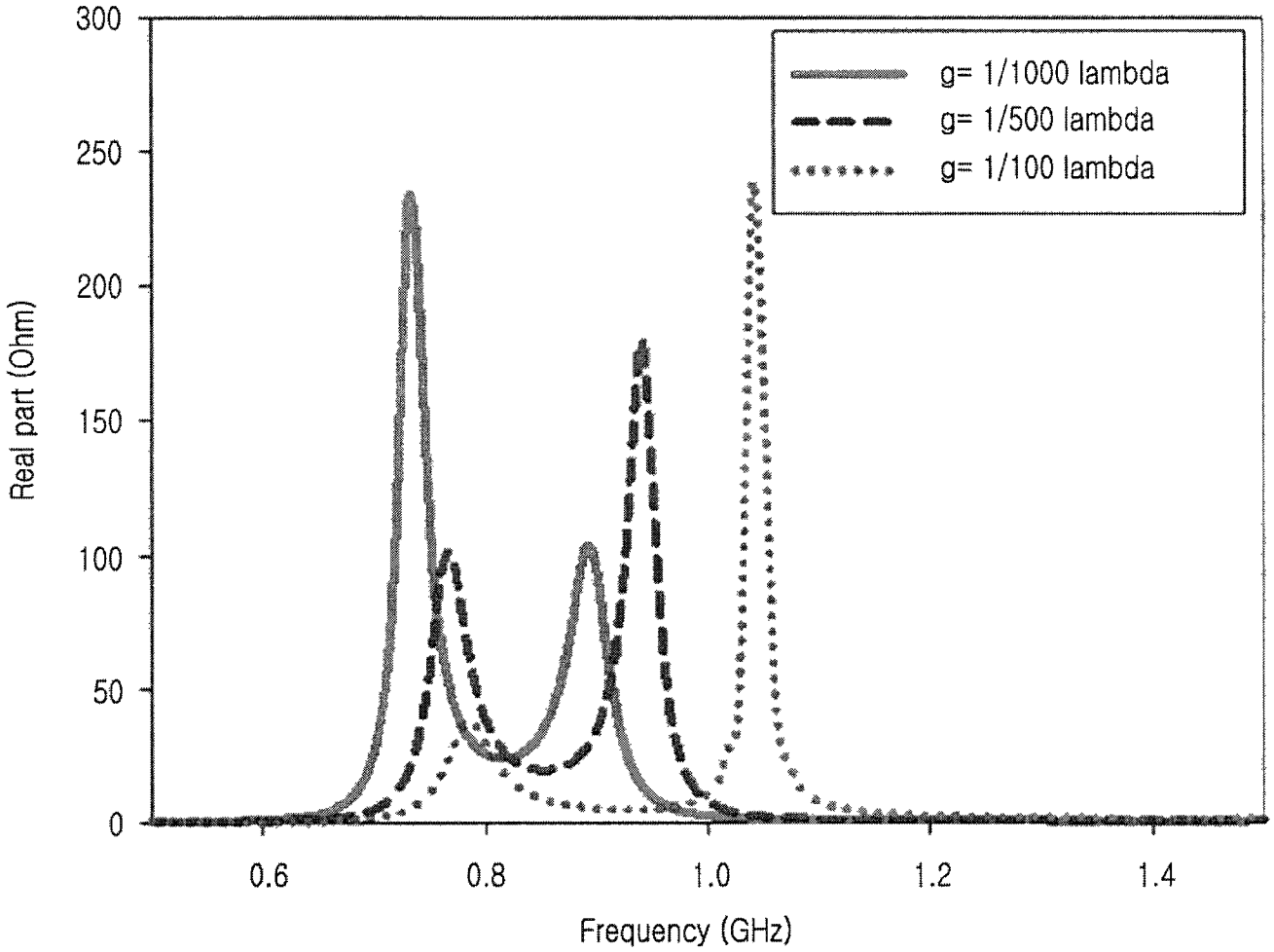
FIGS. 7A to 7C are graphs illustrating a change in an input impedance value and a reflection coefficient depending on a gap between a transmission line and a grounding region according to a preferred embodiment of the present invention.
Figure 7B:
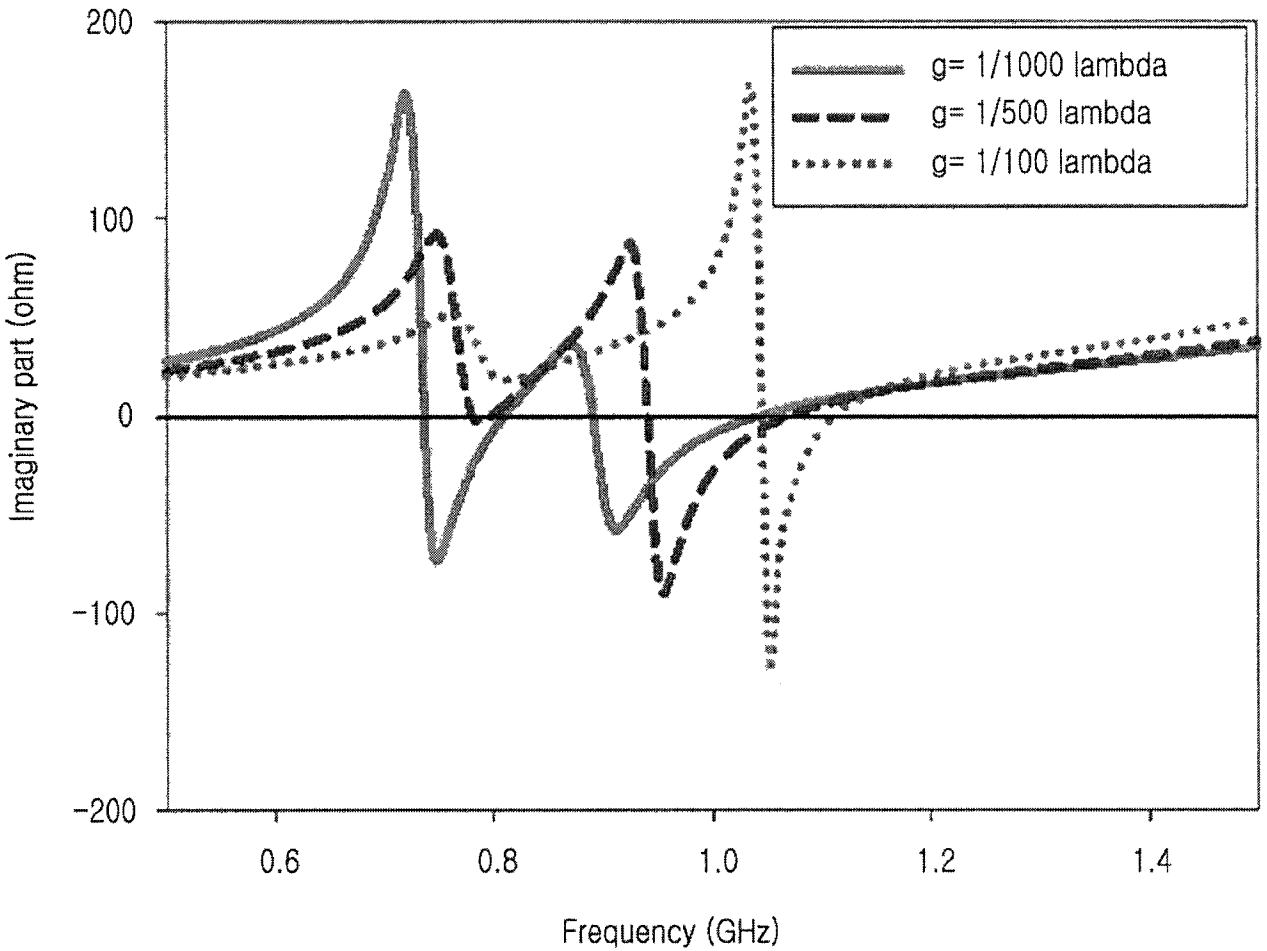
Figure 7C:
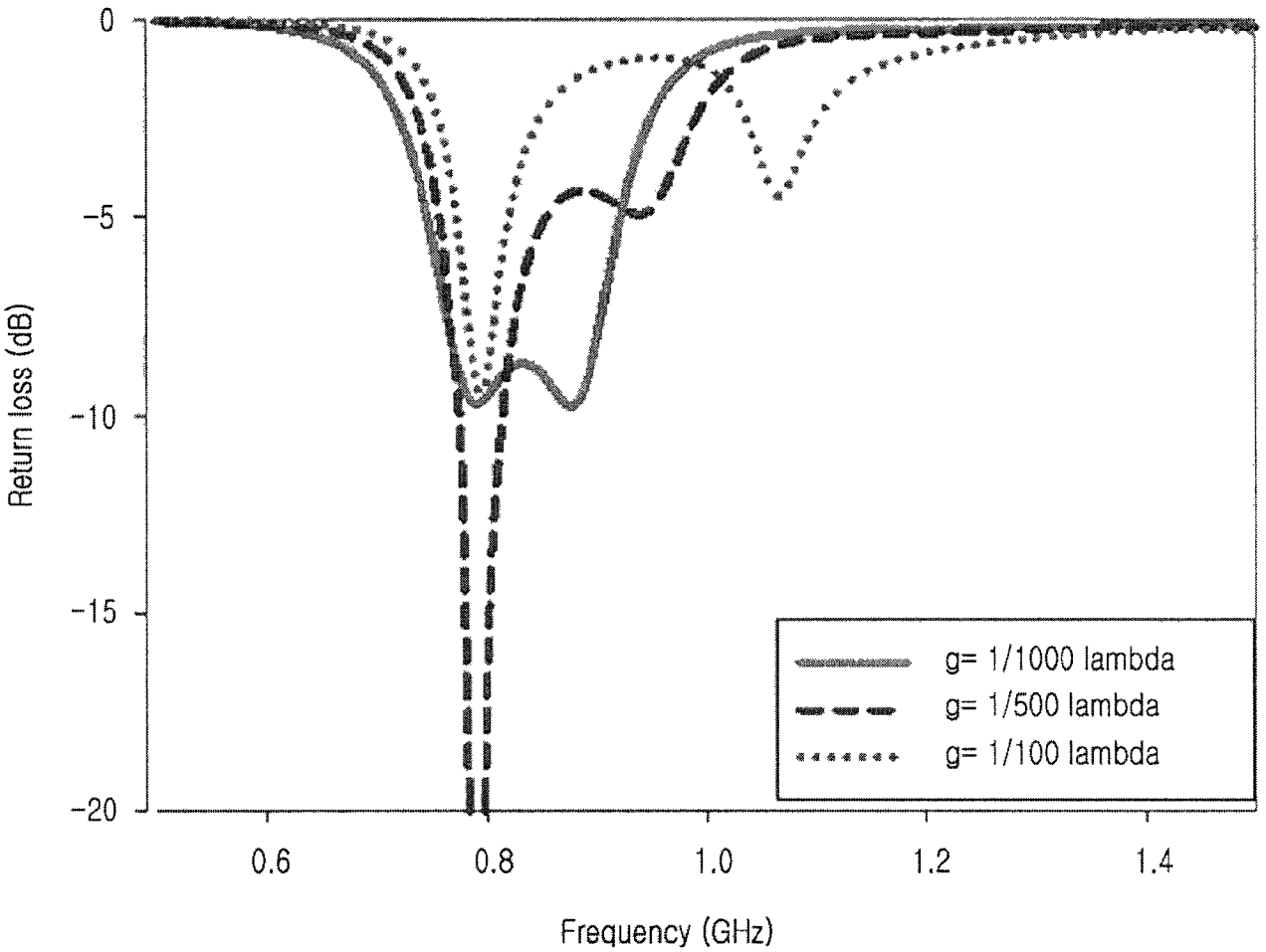

Also, FIGS. 7A to 7C are graphs illustrating a change in an input impedance value and a reflection coefficient depending on a gap between a transmission line and a grounding region according to a preferred embodiment of the present invention. As the gap g between the transmission line and the grounding region changes, the real & imaginary parts of the input impedance of the antenna radiator, and a reflection coefficient change depending on a frequency.

Consequently, as illustrated in the above graphs, the antenna radiator according to the present invention may control a desired resonance band by controlling the length of an added transmission line and the gap between the transmission line and the grounding region.

Figure 8:
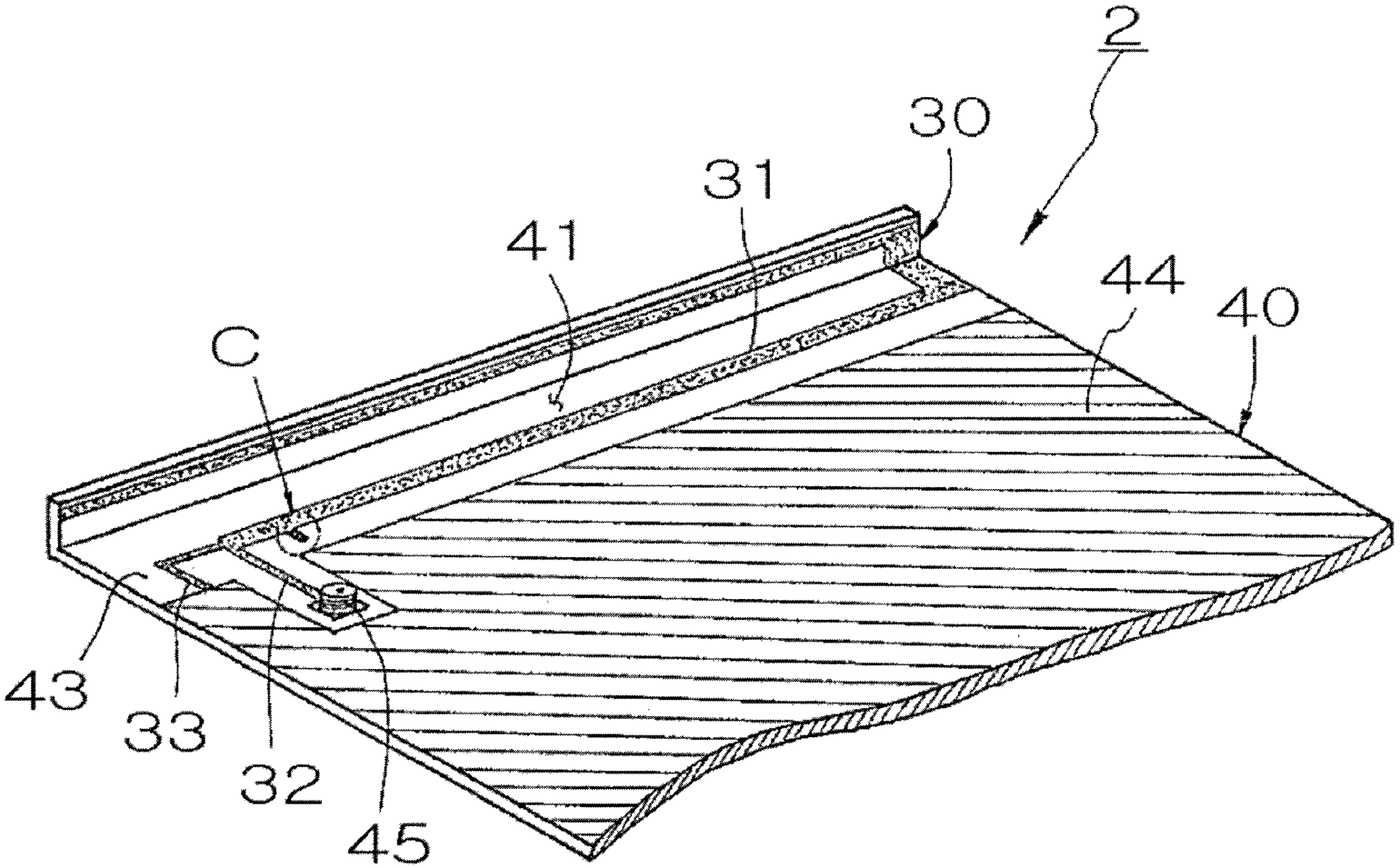
FIG. 8 is a perspective view illustrating a built-in antenna device according to another preferred embodiment of the present invention.
Figure 9:
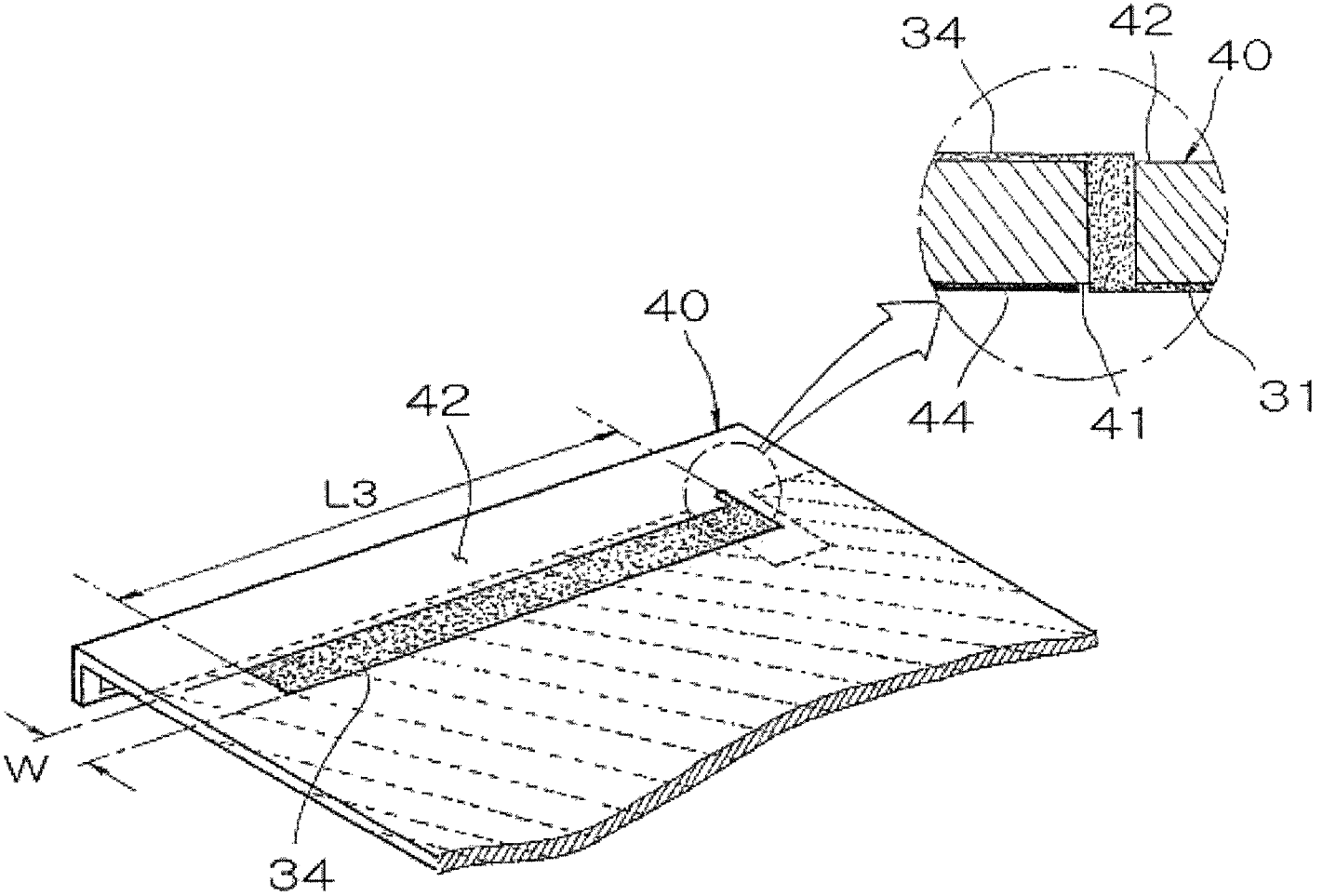
FIG. 9 is a perspective view of a crucial portion illustrating the backside of a substrate of FIG. 8 according to a preferred embodiment of the present invention.

FIG. 8 is a perspective view illustrating a built-in antenna device according to another preferred embodiment of the present invention, and FIG. 9 is a perspective view of a crucial portion illustrating the backside of a substrate of FIG. 8 according to a preferred embodiment of the present invention.

A built-in antenna device according to another embodiment of the present invention has a construction most of which is similar to the construction of FIG. 2. The built-in antenna device includes a substrate having a grounding region 44, a non-grounding region 43, and an antenna radiator 30 installed or formed in the non-grounding region 43 of the substrate 40. Also, the antenna radiator 30 has a PIFA structure, and a feeding line 32 is electrically connected to an RF connector 45 of the substrate 40, and a grounding line 33 is electrically connected to the grounding region 44 of the substrate 40.

However, a transmission line 34 according to the present invention is formed or installed on a second surface 42 different from a first surface 41 of the substrate 40 where the antenna radiator 30 is installed or formed. In this case, one portion among a radiation line 31 of the antenna radiator 30 branches and is connected to the backside which is the second surface 42 of the substrate (refer to a portion C of FIG. 8) through a via, and is directly connected with the transmission line 34 of FIG. 9 through this via. However, since the transmission line 34 and the grounding region 44 formed on the first surface 41 of the substrate 40 do not substantially contact each other, coupling with the grounding region 44 may occur depending on the thickness of the substrate 40 consequently. In this case, as illustrated in FIG. 9, a desired frequency band may be realized by determination of the length $L_3$ and the width W of the transmission line 34.

Although the invention has been shown and described with reference to certain exemplary embodiments thereof, it will be understood by those skilled in the art that various changes in form and details may be made therein without departing from the spirit and scope of the invention as defined by the appended claims and their equivalents. Therefore, the scope of the present invention should not be limited to the above-described embodiments but should be determined by not only the appended claims but also the equivalents thereof.

What is claimed is:

1. A built-in antenna device for an electronic device for communication, the antenna device comprising:

a substrate comprising a grounding region and a non-grounding region;

an antenna radiator disposed in the non-grounding region of the substrate and connected to a feeding portion; and a transmission line branching from the antenna radiator and disposed in vicinity of the grounding region to have a predetermined length and a predetermined width, wherein the transmission line operates as an additional grounding body, wherein the transmission line provides capacitive reactance to the antenna radiator, wherein the predetermined length and predetermined width of the transmission line and a gap between the transmission line and the grounding region are configured to produce a coupling between the transmission line and the grounding region in at least one predetermined frequency range, and wherein the gap between the transmission line and the grounding region is determined as a value to suppress radiating from the transmission line and thereby to prevent the transmission line from operating as a radiator.

2. The antenna device of claim 1, wherein the antenna radiator comprises a grounding line electrically connected to the grounding region of the substrate, and a feeding line electrically connected to the feeding portion.

3. The antenna device of claim 1, wherein the antenna radiator and the transmission line are formed of at least one of a metal plate having a predetermined pattern and a Flexible Printed Circuit (FPC) having the predetermined pattern.

4. The antenna device of claim 1, wherein the transmission line is disposed in the non-grounding region of the substrate.

5. The antenna device of claim 1, wherein the transmission line is coupled to the grounding region to control reactance.

6. The antenna device of claim 1, wherein the transmission line is disposed on a same surface where the antenna radiator of the substrate has been installed.

7. The antenna device of claim 1, wherein the transmission line is disposed in parallel with a boundary portion of the grounding line.

8. The antenna device of claim 1, wherein an electric length of the transmission line is not greater than $\lambda/4$.

9. The antenna device of claim 7, wherein the gap between the transmission line and the boundary portion of the grounding region is not greater than $\lambda/100$.

10. The antenna device of claim 1, wherein the transmission line is disposed on a surface facing a surface where the antenna radiator of the substrate has been installed.

11. The antenna device of claim 10, wherein the transmission line branches from the antenna radiator and then is electrically connected through a via.

12. The antenna device of claim 10, wherein the transmission line is formed in a region overlapping the grounding region of the substrate.

13. The antenna device of claim 10, wherein the transmission line is formed in a region not overlapping the grounding region of the substrate.

14. The antenna device of claim 10, wherein reactance of the antenna radiator is controlled by a length and a width of the transmission line.

15. The antenna device of claim 1, wherein the transmission line and the gap are configured such that the antenna radiator operates in a frequency band of 700 MHz~2170 MHz.

16. The antenna device of claim 1, wherein the antenna radiator and the grounding region form a first conductive pattern, and the antenna radiator and the transmission line form a second conductive pattern.

* * * * *